US006477735B2

(12) United States Patent
Wörwag

(10) Patent No.: US 6,477,735 B2
(45) Date of Patent: Nov. 12, 2002

(54) VACUUM CLEANING TOOL WITH AN OUTLET RAMP

(75) Inventor: Peter Wörwag, Staad (CH)

(73) Assignee: Düpro AG, Romanshorn (CH)

( * ) Notice: Subject to any disclaimer, the term of this patent is extended or adjusted under 35 U.S.C. 154(b) by 0 days.

(21) Appl. No.: 09/943,568

(22) Filed: Aug. 30, 2001

(65) Prior Publication Data

US 2002/0042968 A1 Apr. 18, 2002

(30) Foreign Application Priority Data

Aug. 31, 2000 (DE) ..... 100 42 665

(51) Int. Cl.[7] ..... A47L 9/04
(52) U.S. Cl. ..... 15/387
(58) Field of Search ..... 15/387, 377

(56) References Cited

U.S. PATENT DOCUMENTS 2,812,155 A * 11/1957 Woodruff ..... 15/387
4,306,330 A * 12/1981 Jinkins ..... 15/325
5,008,973 A * 4/1991 Worwag ..... 15/331
5,249,333 A 10/1993 Worwag
5,950,275 A 9/1999 Worwag
6,151,752 A 11/2000 Melzner et al.

FOREIGN PATENT DOCUMENTS

DE 42 29 030 3/1994

* cited by examiner

*Primary Examiner*—Chris K. Moore
(74) *Attorney, Agent, or Firm*—Gudrun E. Huckett

(57) ABSTRACT

A vacuum cleaning tool has a housing with a partition dividing an interior of the housing into a brush chamber and a turbine chamber. A vacuum connector is connected to the housing remote from the brush chamber. A working roller is arranged in the brush chamber. An air turbine is arranged in the turbine chamber and drives in rotation the working roller. A vacuum air flow enters the brush chamber, flows from the brush chamber through an intake window into the turbine chamber, flows within the turbine chamber through the air turbine, and exits from the turbine chamber to the vacuum connector. The turbine chamber has a chamber bottom with a ramp ascending toward the outlet window in the area where the vacuum airflow exits from the turbine chamber. The ramp is through-shaped and has a groove extending in the flow direction of the vacuum airflow.

21 Claims, 4 Drawing Sheets

VACUUM CLEANING TOOL WITH AN OUTLET RAMP

BACKGROUND OF THE INVENTION

1. Field of the Invention

The invention relates to a vacuum cleaning tool for a vacuum cleaning device comprising a housing in which a brush chamber and a turbine chamber are provided. A working roller, in particular, a brush roller, is arranged in the brush chamber transversely to the working direction of the vacuum cleaning tool. The working roller penetrates with a peripheral portion a suction slot provided in the bottom of the brush chamber. An air turbine is arranged in the turbine chamber for driving in rotation the working roller. A vacuum air flow of the vacuum cleaning tool enters the brush chamber via the suction slot, flows into the turbine chamber via an intake window provided in a partition between the brush chamber and the turbine chamber, and exits from the turbine chamber through an outlet window of a vacuum connector. In the flow direction of the vacuum airflow, the outlet window is positioned higher than the intake window. The turbine chamber has a chamber bottom and the chamber bottom has a ramp ascending toward the outlet window in the area where the vacuum airflow exits from the turbine chamber.

2. Description of the Related Art

In the housing of the vacuum cleaning tool according to U.S. Pat. No. 5,249,333, a brush chamber and a turbine chamber are formed. In the brush chamber a brush roller is arranged transversely to the working direction and penetrates to the exterior through a suction slot in the housing bottom of the brush chamber. For driving in rotation the brush roller, an air turbine is arranged in the turbine chamber which drives the brush roller by means of a belt drive. A vacuum airflow enters the brush chamber through the suction slot and flows into the turbine chamber through an intake window in the partition between the brush chamber and the turbine chamber. The vacuum air flow exits from the turbine chamber through an outlet window. The air turbine is formed as a so-called direct flow turbine, i.e., between two neighboring vanes a flow path is formed which opens into the center of the air turbine. The vacuum air flow therefore enters the vane-free center of the air turbine by flowing through the annular vane arrangement at one end and performs again work when exiting this center at the opposite end by flowing again through the annular vane arrangement.

This known configuration of a vacuum cleaning tool ensures a great output of the air turbine which, for strong vacuum air flows, is within the magnitude of an electric motor which can be used as an alternative for driving the brush roller.

SUMMARY OF THE INVENTION

It is an object of the present invention to further develop the vacuum cleaning tool of the aforementioned kind such that even for weaker vacuum air flows a strong turbine power output for driving the working roller is made available.

In accordance with the present invention, this is achieved in that the ramp provided on the turbine chamber bottom is trough-shaped with a groove extending in the flow direction of the vacuum airflow.

In the flow direction of the vacuum airflow the outlet window is positioned higher than the intake window so that the vacuum airflow is directed upwardly toward the outlet window. In this way, the vacuum airflow safely passes through the annular vane arrangement, enters the center of the turbine, and safely exits this center again. In the outflow area of the vacuum airflow the turbine chamber bottom is formed as a ramp and ascends to the outlet window wherein in the flow direction of the vacuum airflow the terminal edge of the ramp is positioned approximately at the level of the housing edge of the outlet window. In this way, the fault flow or secondary air which flows near the turbine chamber bottom is also guided in a directed way to the outlet window and can flow out without disruption. The deflected fault flow or secondary air therefore cannot impede the outflow of the vacuum airflow, which performs the work, so that indirectly the turbine power output is increased in this way.

The ramp is expediently trough-shaped with a groove extending in the flow direction of the vacuum airflow wherein the groove advantageously is matched in the area of the air turbine to the width of the air turbine and at the outlet side to the size of the outlet window. In this connection, the trough-shaped groove can be guided into the outlet window, in particular, can penetrate into it.

Preferably, the center of the outlet window is located as a point on the straight extension of the ramp surface which preferably symmetrically divides the outflow window at its center.

In a further embodiment of the invention a connecting line between the upper edge of the outflow window and the upper edge of the intake window is positioned below the hub of the air turbine. The circle segment of the air turbine cross-section which is separated by this connecting line has a surface area which is approximately 30% to 45% of the cross-sectional surface area of the air turbine.

When the annular vane arrangement has approximately 10 to 14 vanes and a connecting line is drawn between approximately the center of the intake window and approximately the center of the outlet window, this connecting line will intersect the air turbine as a secant. The circle segment which is separated by the secant has a circular arc which corresponds to the spacing of four to six, preferably five vanes, of the annular vane arrangement of the air turbine.

DESCRIPTION OF THE PREFERRED EMBODIMENTS

Figure 1:
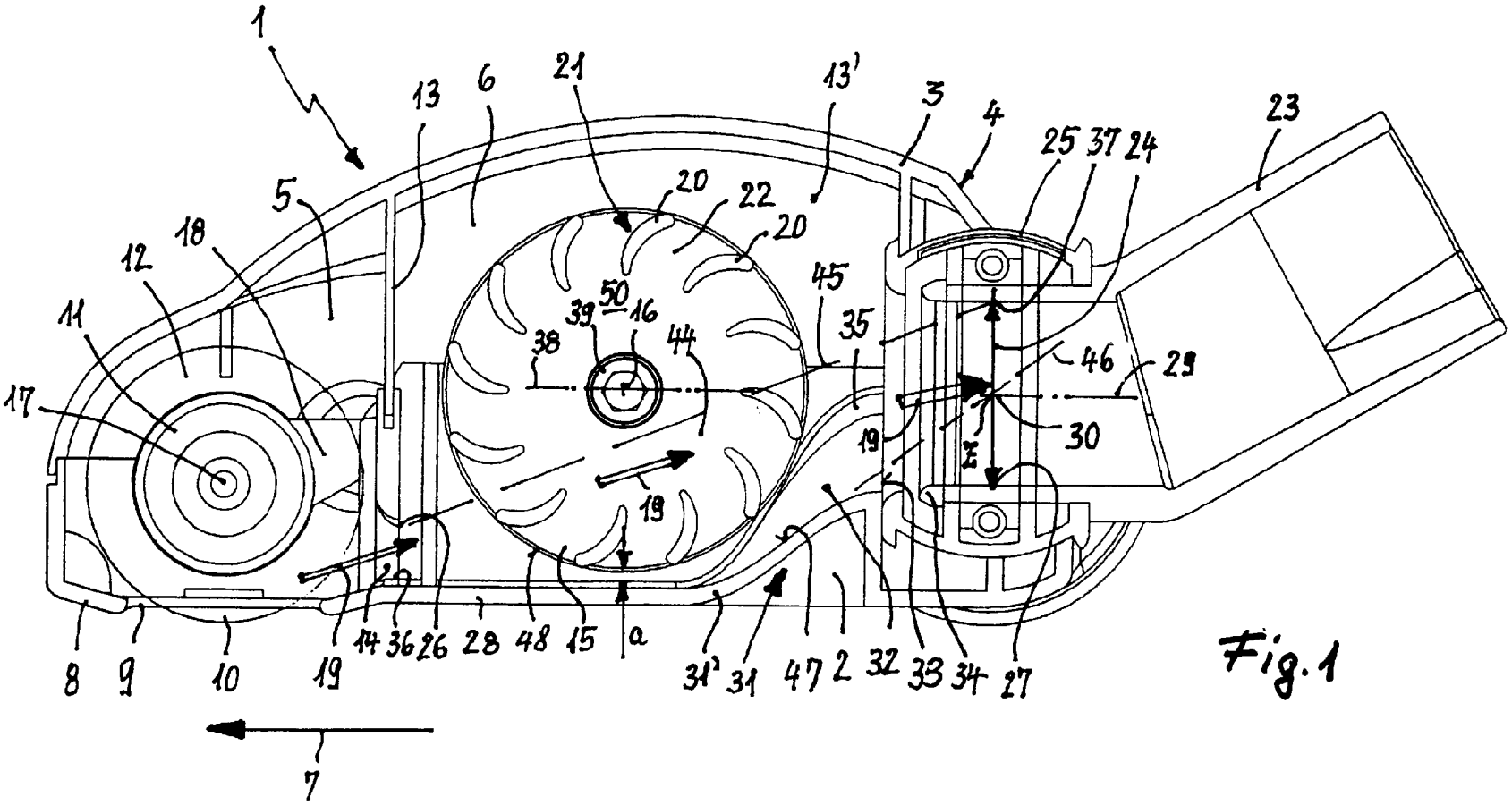
FIG. 1 is a longitudinal section of a first embodiment of a vacuum cleaning tool according to the invention.

The illustrated vacuum cleaning tools according to FIGS. 1 through 4 have the same basic configuration which is therefore explained only in connection with FIG. 1.

The vacuum cleaning tool 1 has a housing 4 which is comprised of a bottom housing part 2 and a top housing part 3. In the housing 4 a brush chamber 5 and a turbine chamber 6 are provided. In the working direction 7 of the vacuum cleaning tool 1 the brush chamber 5 is arranged at the leading end and has a working roller 11 arranged therein extending transversely to the working direction 7. In the illustrated embodiment the working roller 11 is a brush roller. The brush roller 11 has a bristle arrangement 12 which penetrates with its peripheral portion 10 a suction slot 9 provided in the housing bottom 8. The suction slot 9 extends transversely to the working direction 7 across the entire width of the vacuum cleaning tool 1.

In the inferior of the housing 4, the brush chamber 5 is separated from the turbine chamber 6 by an inner partition 13. An intake window 14 is provided within the partition 13 near the bottom 28 of the turbine chamber 6, and in the illustrated embodiment it is positioned at the level of the turbine chamber bottom 28. The turbine chamber bottom 28 thus forms a boundary the intake window 14.

An air turbine 15 is arranged in the turbine chamber 6 which is driven by a vacuum airflow 19. The air turbine 15 has an axis of rotation 16 positioned transversely to the working direction 7 and is secured and supported in the axial sidewalls 13' of the turbine chamber 6. By means of the belt drive 18, which is only schematically illustrated, the air turbine 15 drives in rotation the working roller 11 about its bearing axle 17. The turbine chamber 6 has at its end facing away from the partition 13 a vacuum connector 23 whose tube end is rotatably supported about an axis of rotation 29 in a part-cylindrical swivel part 25. The swivel part 25 is movable about a swivel axis 30 so that the vacuum connector 23 can be moved up and down. The outlet window 24 of the vacuum connector 23 is positioned within the swivel part 25 such that the center of the outlet window 24 is at the same time the point of intersection of the swivel axis 30 of the swivel part 25 and of the axis of rotation 29 of the vacuum connector 23.

The annular vane arrangement 21 of the air turbine 15 has a plurality of vanes 20 arranged about its circumference at an equidistant spacing to one another, wherein preferably approximately 10 to 14 such vanes 20 are arranged within the annular vane arrangement 21. In the illustrated embodiment, 12 such vanes 20 are provided. Between neighboring vanes 20, open flow paths 22 are formed which open toward the center 50 of the air turbine 15 so that the vacuum airflow 19 on its way from the intake window 14 to the outlet window 24 will flow through the vane-free center 50 of the air turbine 15.

In order to ensure flow of the vacuum airflow 19 through the air turbine 15, it is suggested to position the mantle surface 48 of the air turbine 15 at a minimal distance a from the turbine chamber bottom 28. The lower edge 36 of the intake window 14 is positioned approximately at the level of the turbine chamber bottom 28 while the upper edge 26 of the intake window 14 in the flow direction is positioned approximately below the lower edge 27 of the outlet window 24. In this connection, the cross-section of the preferably circular outlet window 24 is larger, preferably several times larger, than the cross-section of the preferably rectangular intake window 14.

A connecting line 45 between the upper edge 37 of the outlet window 24 and the upper edge 26 of the intake window 14 extends below the axis of rotation 16 or the hub 39 of the air turbine 15. The connecting line 45 separates a circle segment 44 from the cross-section of the air turbine 15 wherein the surface area of the circle segment 44 is approximately 30% to 45% of the cross-sectional surface area of the air turbine 15.

Figure 2:
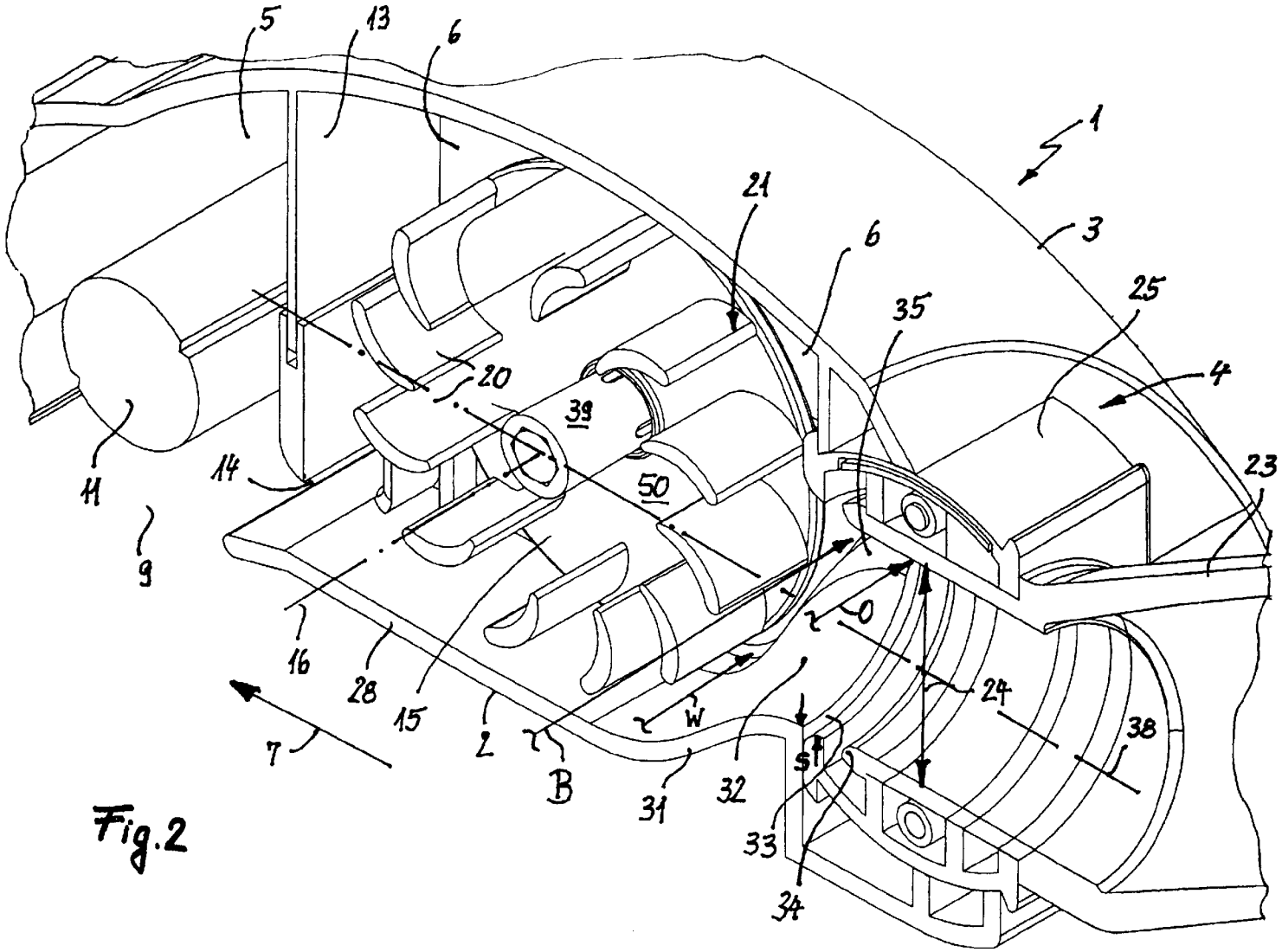
FIG. 2 is an enlarged perspective illustration of a detail of the vacuum cleaning tool according to FIG. 1.

In order to provide a high power output of the air turbine 15, it is proposed to configure in particular the outlet area of the turbine chamber 6 in a flow-enhancing way. Since the outlet window 24 is positioned higher than the intake window 14, the height difference must be bridged in a flow-enhancing way. For this purpose, it is proposed to embody the turbine chamber bottom 28 in the outlet area of the turbine chamber 6 as a ramp 31 which ascends toward the outlet window 24. In the flow direction of the vacuum airflow 19, the terminal edge 33 of the ramp 31 is positioned at the level of the housing edge 34 or the lower edge 27 of the outlet window 24 or the vacuum connector 23. In order to provide also a lateral guiding of the vacuum airflow 19 into the outlet window 24, the ramp 31 is trough-shaped with a groove 32 extending in the flow direction of the vacuum airflow 19. In this connection, as illustrated in particular in FIGS. 2 and 4, the maximum opening width W of the groove 32 measured transverse to the flow direction of the vacuum airflow 19 is slightly greater than the width B of the air turbine 15 measured in the direction of the axis of rotation 16. The opening width of the groove 32 near the air turbine 15 is greater than at the outlet end facing the outlet window 24. As illustrated in FIG. 2, the groove 32 tapers from its maximum opening width W in the area of the air turbine 15 to its outlet width A at the outlet window 24. For a lateral guiding action at the outlet end of the groove 32, sidewalls 35 are provided which extend to approximately half the height of the outlet window 24 (FIG. 1). Expediently, the terminal edge 33 projects past the housing edge 34 by an amount s, as shown in FIG. 2. The trough-shaped groove 32 can also extend into the outlet window 24, in particular, can penetrate into it, in order to avoid power-reducing air turbulence in the area of the transition of the groove 32 into the outlet window 24. At the level of the outlet window 24, respectively, shortly before the outlet window 24, the cross-section of the groove 32 corresponds to approximately half a cross-section of the outlet window 24. The groove cross-section or the terminal edge 33 of the groove 32 in the flow direction of the vacuum airflow 19 substantially covers the edges of the outlet window 24 or the housing edge 34 of the outlet window 24.

The base 31' of the ramp 31 is positioned in the flow direction of the vacuum airflow 19 downstream of the axis of rotation 16 and ascends from there substantially uniformly up to the level of the housing edge 34. The air that is flowing at the level of the air turbine 15 is already guided in the area of the ramp base 31' in the direction toward the outlet window 24 so that a good direction of the exiting vacuum air flow is provided. In addition to the direction of the vacuum air flow in the direction of the outlet window 24, the groove 32 o provides a collecting function. In the outlet area of the vacuum air flow 19 from the annular vane arrangement 21, non-directional flow portions of the vacuum air flow 19 are caught and guided in the direction toward the outlet window 24. The close positioning of the mantle surface 48 of the air turbine 15 relative to the turbine chamber bottom 28 ensures in connection with the ramp 31 an easy flow action through the air turbine 15. The area between the turbine chamber bottom 28 and the mantle surface 48 of the air turbine 15 presents a disturbing resistance for the vacuum air flow 19 so that the vacuum air flow 19 is instead forced through the air turbine 15 in a power-increasing way. In this connection, the ramp at the outlet of the vacuum air flow provides an ordered flow into the vacuum connector 23 wherein, as a result of the selected large cross-section of the outlet window 24, a resistance disturbing the exit flow is substantially prevented.

As a result of the arrangement of the air turbine 15 at the level of the longitudinal center axis 38 an excellent initial position for an power-efficient operation is selected. The longitudinal center axis 38 is positioned at the level of the axis of rotation 29 of the vacuum connector 23. The center Z of the outlet window 24 is positioned also on or near the longitudinal center axis 38.

Figure 3:
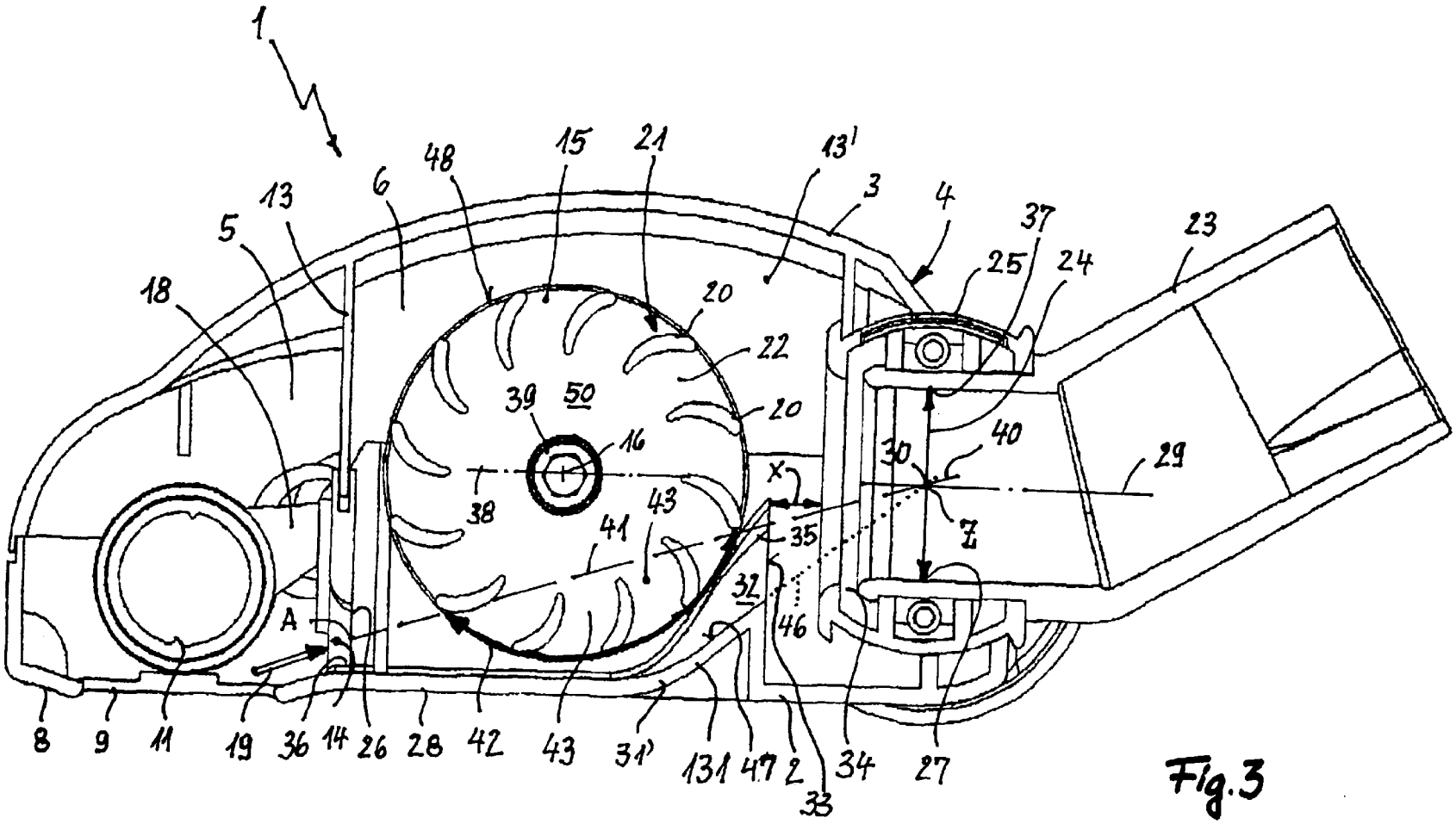
FIG. 3 is a longitudinal section of a second embodiment of a vacuum cleaning tool according to the invention.
Figure 4:
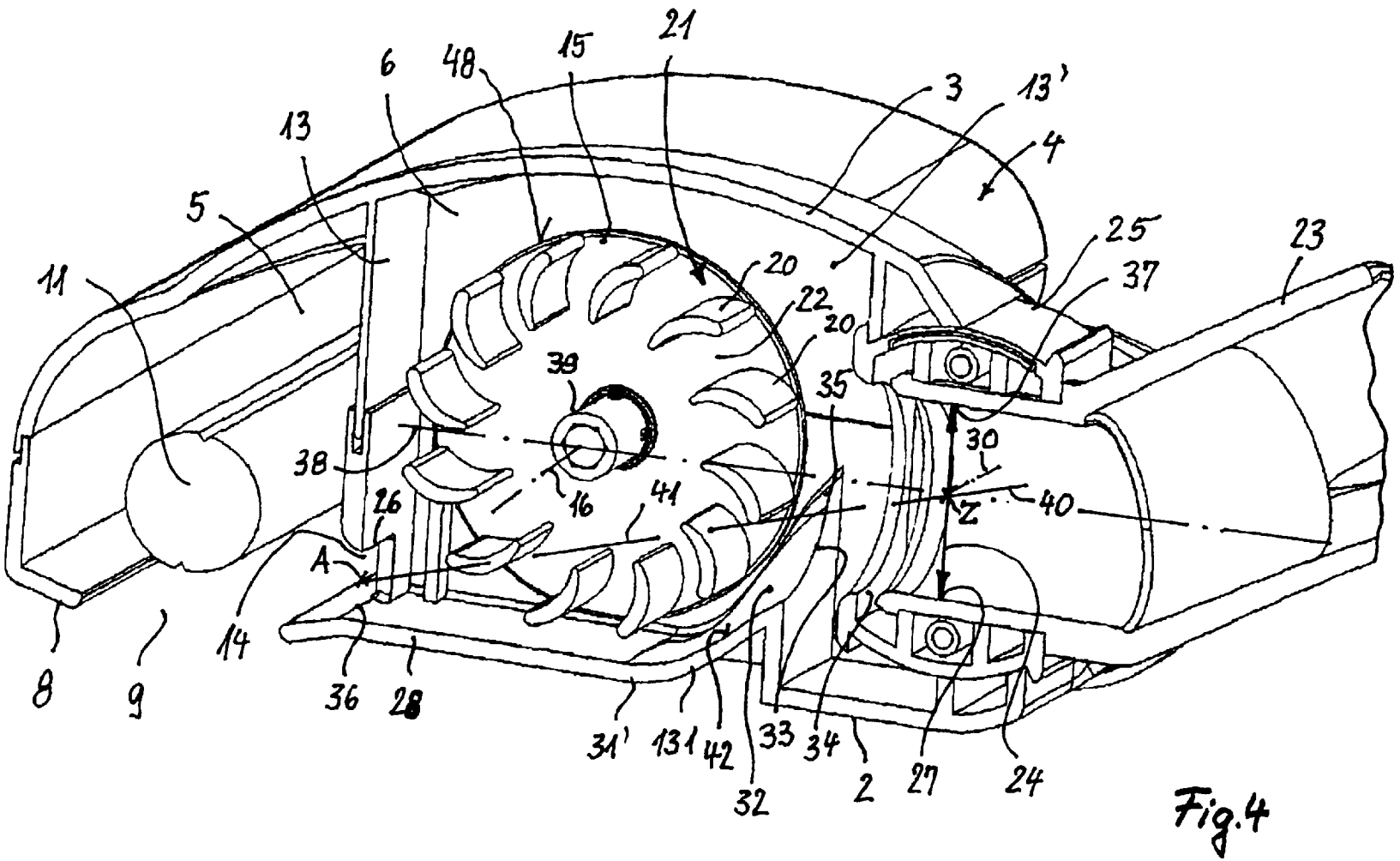
FIG. 4 is a perspective illustration of the vacuum cleaning tool according to FIG. 3.

The embodiment according to FIGS. 3 and 4 differs in regard to the length of the ramp from the embodiment according to FIGS. 1 and 2. For same parts the same reference numerals are used.

The ramp 131 ends at a spacing x before the housing edge 34 of the outlet window 24. The embodiment of the ramp is configured such that the center Z is a point on the extension 46 of the ramp surface. As a result of the selected incline of the ramp 31 with alignment of the ramp surface relative to the center Z of the outlet window 24, the spacing x can be bridged without causing great air turbulence. Such a spacing x to the ramp 131 is expedient for a larger movement range of the swivel part 25 in order to increase the movability of the socket of the vacuum connector 23.

An advantageous spatial arrangement of the outlet window 24, the intake window 14, and the air turbine 15 results when the annular vane arrangement 21 of the air turbine comprises approximately 10 to 14, preferably 12, vanes and when a connecting line 40 between approximately the center of the intake window 14 and approximately the center of the outlet window 24 intersects the cross-section of the air turbine 15 as a secant 41. The circle segment 43 separated by the secant 41 has a circular arc 42 whose length corresponds to the spacing of four to six, preferably five vanes 20.

The ramp 31 has a ramp surface 47 whose extension line 46 extends through the center of the outlet window 24. Preferably, the imaginary extension line 46 of the ramp surface 47 divides the outlet window 24 at the center, in particular, symmetrical thereto.

While specific embodiments of the invention have been shown and described in detail to illustrate the inventive principles, it will be understood that the invention may be embodied otherwise without departing from such principles.

What is claimed is:

1. A vacuum cleaning tool for a vacuum cleaning device, the vacuum cleaning tool comprising:

a housing (4) having a partition (13) dividing an interior of the housing (4) into a brush chamber (5) and a turbine chamber (6), wherein the brush chamber (5) has a bottom (8) and a suction slot (9) arranged in the bottom (8), and wherein the partition (13) has an intake window (14);

a vacuum connector (23) connected to the housing (4) remote from the brush chamber (5), wherein the vacuum connector (23) has an outlet window (24);

a working roller (11) arranged in the brush chamber (5) perpendicularly to a working direction (7) of the vacuum cleaning tool and having a peripheral portion (10) projecting from the brush chamber (5) through the suction slot (9) to the exterior of the housing (4);

an air turbine (15) arranged in the turbine chamber (6) and configured to drive in rotation the working roller (5);

wherein a vacuum air flow (19) enters the brush chamber (5) via the suction slot (9), flows from the brush chamber (5) through the intake window (14) into the turbine chamber (6), flows within the turbine chamber (6) from the intake window (14) to the outlet window (24) through the air turbine (15), and exits from the turbine chamber (6) through the outlet window (24);

wherein in a flow direction of the vacuum airflow (19) the outlet window (24) is positioned higher than the intake window (14);

wherein the turbine chamber (6) has a chamber bottom (28) and the chamber bottom (28) has a ramp (31) ascending toward the outlet window (24) in the area where the vacuum airflow (19) exits from the turbine chamber (6);

wherein the ramp (31) is trough-shaped and has a groove (32) extending in the flow direction of the vacuum airflow (19).

2. The vacuum cleaning tool according to claim 1, wherein the working roller is a brush roller (11).

3. The vacuum cleaning tool according to claim 1, wherein the groove (32) has a first end positioned proximal to the air turbine (15) and a second end positioned proximal to the outlet window (24), wherein the groove (32) has an opening width that is greater at the first end than at the second end.

4. The vacuum cleaning tool according to claim 3, wherein the air turbine (15) rotates about an axis of rotation (16) and has a width (B) measured along the axis of rotation (16), wherein the opening width of the groove (32) is measured transversely to the flow direction of the vacuum flow (19) and wherein the opening width has a maximum width (W) that is slightly greater than the width (B) of the air turbine (15).

5. The vacuum cleaning tool according to claim 3, wherein the second end of the groove (32) has sidewalls (35) ending approximately at half the height of the outlet window (24).

6. The vacuum cleaning tool according to claim 5, wherein the groove (32) extends into the outlet window (24).

7. The vacuum cleaning tool according to claim 6, wherein the groove (32) projects into the outlet window (24).

8. The vacuum cleaning tool according to claim 3, wherein the second end of the groove (32) has a groove cross-section matching substantially half a cross-section of the outlet window (24), wherein the groove cross-section in the flow direction of the vacuum airflow (19) covers at least substantially a lower edge (34) of the outlet window (24).

9. The vacuum cleaning tool according to claim 3, wherein in the flow direction of the vacuum airflow (19) the ramp (31) has a terminal edge (33) positioned substantially at the level of the lower edge (34) of the outlet window (24).

10. The vacuum cleaning tool according to claim 9, wherein the terminal edge (33) of the ramp (31) substantially covers the lower edge (34) of the outlet window (24).

11. The vacuum cleaning tool according to claim 1, wherein a straight extension line (46) of the ramp (31) symmetrically divides the outlet window (24) at a center (Z) of the outlet window (24).

12. The vacuum cleaning tool according to claim 1, wherein the air turbine (15) has a mantle surface (48) positioned at a minimal spacing (a) to the chamber bottom (28).

13. The vacuum cleaning tool according to claim 1, wherein a cross-section of the outlet window (24) is greater than a cross-section of the intake window (14).

14. The vacuum cleaning tool according to claim 13, wherein the cross-section of the outlet window (24) is circular and wherein the cross-section of the intake window (14) is rectangular, and wherein the cross-section of the outlet window (24) is several times greater than the cross-section of the intake window (14).

15. The vacuum cleaning tool according to claim 1, wherein the intake window (14) has a lower edge (36) positioned approximately at the level of the chamber bottom (28).

16. The vacuum cleaning tool according to claim 1, wherein the intake window (14) has an upper edge (26) and wherein the outlet window (24) has a lower edge (27), wherein the upper edge (26) of the intake window (14) is positioned approximately below the lower edge (27) of the outlet window (24).

17. The vacuum cleaning tool according to claim 1, wherein the air turbine (15) has vanes (20) arranged in an annular vane arrangement (21) with a vane-free center (50), wherein between the vanes (20) free flow paths (22) are provided extending toward the vane-free center (50), wherein the vacuum airflow (19) flows through the vane-free center (50) on a path from the intake window (14) to the outlet window (24).

18. The vacuum tool according to claim 17, wherein the annular vane arrangement (21) comprises 10 to 14 vanes (20), wherein an imaginary connecting line between a central area (A) of the intake window (14) and a central area (Z) of the outlet window (24) intersects the cross-section of the air turbine (15) as a secant (41) to define a circle segment (43), wherein within the circle segment (43) four to six of the vanes (20) of the annular vane arrangement (21) are arranged.

19. The vacuum cleaning tool according to claim 18, wherein five of the vanes (20) are arranged within the circle segment (43).

20. The vacuum cleaning tool according to claim 1, wherein the intake window (14) has an upper edge (26) and the outlet window (24) has an upper edge (37), wherein a connecting line (45) between the upper edge (26) of the intake window (14) and the upper edge (37) of the outlet window (24) extends below a hub (39) of the air turbine (15).

21. The vacuum cleaning tool according to claim 20, wherein the connecting line (45) delimits a circle segment (44) of the cross-section of the air turbine (15), and wherein a surface area of the circle segment (44) is substantially 30% to 45% of a cross-sectional surface area of the air turbine (15).

* * * * *